United States Patent [19]

Schaller

[11] Patent Number: 4,512,232

[45] Date of Patent: Apr. 23, 1985

[54] TREMOLO TAILPIECE AND BRIDGE DEVICE

[76] Inventor: Helmut F. K. Schaller, Postfach 1225, D-8501 Feucht, Fed. Rep. of Germany

[21] Appl. No.: 457,748

[22] Filed: Jan. 13, 1983

[51] Int. Cl.[3] ..... G10D 3/12

[52] U.S. Cl. ..... 84/313; 84/297 R; 84/312 R

[58] Field of Search ..... 84/297 R, 298, 299, 84/307, 312, 313

[56] References Cited

U.S. PATENT DOCUMENTS

| | | | |
|---|---|---|---|
| 2,519,044 | 8/1950 | Hise | 84/312 P |
| 2,573,963 | 11/1951 | Gaut | 84/312 P |
| 2,972,923 | 2/1961 | Fender | 84/313 |
| 3,139,783 | 7/1964 | Grant et al. | 84/411 R |
| 3,181,409 | 5/1965 | Burns et al. | 84/313 |
| 3,237,502 | 3/1966 | Moseley | 84/313 |
| 3,457,821 | 7/1969 | McCarty et al. | 84/313 |
| 4,137,812 | 2/1979 | Franzmann | 84/313 |
| 4,457,210 | 7/1984 | Storey | 84/313 |

*Primary Examiner*—Lawrence R. Franklin

*Attorney, Agent, or Firm*—McCormick, Paulding & Huber

[57] ABSTRACT

A tremolo tailpiece and bridge device for use with a guitar or similar stringed instrument includes a plurality of string anchors, forming the tailpiece, to which the lower ends of the strings of the instrument are attached, and an associated bridge unit located ahead of the tailpiece in the direction toward the instrument neck. Both the string anchors and the bridge are rotatable about axes extending transversely of the strings. A tremolo arm operable by the player is connected with the string anchors for rotating them back and forth in unison to obtain a tremolo effect, and the bridge unit is drivingly connected with the string anchors or tremolo arm so that it is rotated back and forth in synchronism with the motion of the string anchors, thereby avoiding any tendency of the strings to move relative to the bridge. The plurality of string anchors may be provided by a single one-piece rotatable bar or by a plurality of string engaging members rotatably received by a common shaft and operated by a transversely extending member through fine tuning screws.

33 Claims, 15 Drawing Figures

TREMOLO TAILPIECE AND BRIDGE DEVICE

BACKGROUND OF THE INVENTION

This invention relates to guitars and similar stringed musical instruments and deals more particularly with a bridge and tailpiece device for use with such a guitar and operable by the player of the instrument to increase and decrease the tension applied to one end of the strings to create a tremolo effect.

Various different tremolo devices have been proposed in the past and have been used to create a tremolo effect in the sound produced by a guitar or similar stringed musical instrument. In a common form of such device the tailpiece or string anchor to which the lower ends of the strings are attached is somehow slid back and forth relative to the instrument body, or otherwise moved, by the player through the use of a lever (tremolo arm) located near the playing area to alternately increase and decrease the string tension. That is, the lower ends of the strings are actually moved back and forth from their neutral position to alternately slightly stretch and relax them.

Since the bridge of an instrument is normally located a short distance ahead of the tailpiece in the direction of the neck, the movement of the lower end of the strings requires, if the bridge is stationary, that the individual strings move or at least be urged to move over the associated bridge saddle or saddles. If the string involved is a wound string the movement of convolutions of the wrap wire over the associated saddle causes a string noise; and, regardless of the type of string construction, the friction between the string and the bridge resists the desired relative motion. This could result in the tension of any one string between the tailpiece and the bridge becoming different from its tension between the bridge and the nut, in turn causing tuning problems.

Also, the production of a tremolo effect is usually required only at infrequent intervals and when it is not required the presence of the tremolo arm may be a hinderance to the player so that it is desirable that the tremolo arm be movable to an out of the way position when the tremolo effect is not desired, and this is sometimes not possible with prior art constructions.

The general object of the invention is therefore to provide a tremolo bridge and tailpiece device which is improved over such devices previously proposed by the prior art.

A more specific object of the invention is to provide such a tremolo tailpiece and bridge device wherein the tendency of the strings to be moved relative to the bridge is eliminated thereby eliminating the production of associated string noises and undesirable tuning problems arising from the friction between the strings and the bridge resisting relative string to bridge motion.

Another object of the invention is to provide a tremolo tailpiece and bridge device of the foregoing character wherein the tremolo effect is achieved without changing the position of the string relative to the bridge.

A further object of the invention is to provide a tremolo tailpiece and bridge device which may be designed for mounting to a guitar or similar stringed instrument in various different ways as by partially recessing it into the body of a solid body guitar or surface mounting it to the top surface of a guitar or incorporating it into a trapeze mechanism attached to the very lower end of a guitar.

A still further object of the invention is to provide a tremolo tailpiece and bridge device as described above wherein the tremolo arm is movable to an out of the way position when not in use and wherein the tremolo arm may be disassembled from the remainder of the device.

Other objects and advantages of the invention will be apparent from the drawings and from the following detailed description of the preferred embodiments.

SUMMARY OF THE INVENTION

The invention relates to a tremolo tailpiece and bridge device for use with a guitar or similar stringed musical instrument and which may be designed for attachment to the instrument in various different ways as by being partially recessed into the instrument body or by lying substantially flatly on the top surface of the instrument body or by being attached to the very lower end of the instrument through a trapeze arrangement.

More particularly the invention resides in the tailpiece and bridge device having a plurality of string anchor means which are rotatable about a common first axis extending transversely to the strings of the instrument and parallel to the top surface of the instrument's body, and a bridge unit located some distance away from the plurality of string anchor means in the direction toward the neck of the instrument and rotatable relative to the instrument about a second axis extending generally parallel to the first axis, and a means, preferably including a tremolo arm, operable by the player for synchronously rotating the string anchor means and the bridge unit back and forth about said first and second axes respectively to produce a tremolo effect in the sound produced by the instrument without any tendency for the strings to move relative to the bridge.

The invention also resides in the plurality of string anchor means comprising either a single one-piece anchor bar to which all of the strings of the instrument are attached and which is rotatable about the first axis or a plurality of string engaging members supported on a common shaft for rotation about the first axis and having individual tail portions to which the strings are attached with the tail portions in turn being operated in unison by a transversely extending operating member with there being a fine tuning mechanism between each tail portion and the operating member.

The invention also resides in the manner in which the tremolo arm may be connected to the string anchor bar to provide for an easy connect and disconnect connection between such two parts, in the manner in which the bridge unit is mounted for movement about its transverse axis and in the manner in which the string anchor means and the bridge unit are drivingly connected to be rotated in synchronism.

DETAILED DESCRIPTION OF THE PREFERRED EMBODIMENTS

Figure 1:
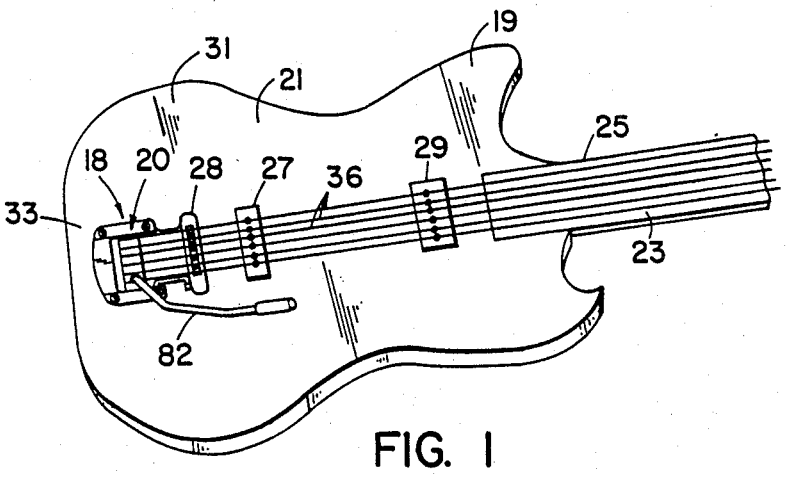
FIG. 1 is a fragmentary perspective view of a guitar equipped with a tremolo tailpiece and bridge device embodying this invention.

A tremolo bridge and tailpiece device embodying the present invention may be used in various different types of stringed musical instruments wherein a tremolo effect is sometimes desired during the playing of the instrument. By way of example, FIG. 1 shows such a device, indicated generally at 18, forming part of a guitar 19. The guitar 19 is one having a solid body 21 and also includes a neck 23, a fingerboard 25 and two electromagnetic pickups 27 and 29. The tremolo tailpiece and bridge device 18 is attached to the guitar body 21 adjacent the top surface 31 of the body at a location near the bottom end 33 of the instrument. As will be evident hereinafter the illustrated device 18 of FIG. 1 is designed to be partially recessed into the body 22, but such design is not important to the broader aspects of the invention and if desired the device may be designed for other types of attachments as for example being designed for surface attachment to the upper surface 31 without significant recessing or for incorporation into a trapeze type mounting attached to the very lower end of the guitar body. Also, in FIG. 1 the illustrated guitar 19 is one having six strings 36, 36 and the device 18 is accordingly designed for use with such a number of strings, but the number of strings for which the device is constructed may vary without departing from the invention.

FIGS. 2 to 10 show the device 18 of FIG. 1 in more detail. Referring to these figures the device includes a tailpiece indicated generally at 20 providing a plurality of string anchor means, one for each of the six strings 36, 36 of the instrument, only one of these strings being shown in FIG. 2. These six string anchor means are in turn provided by a single anchor bar 22 with each of the string anchor means comprising an opening 24 and a groove 26 in the string anchor bar as described in more detail hereinafter. Also included in the device 18 is a bridge unit 28 comprised of a body 30 supporting six individual bridge saddles 32, 32 each of which engages and supports a respectively associated one of the strings 36 with the bridge unit 28 being located a short distance ahead of the tailpiece 20 in the direction of the neck 23.

The plurality of string anchor means, constituted by the anchor bar 22, is rotatable relative to the instrument body 21 about a first axis 38 extending generally parallel to the top surface 31 of the instrument and perpendicular to the direction of the strings 36, 36. Likewise, the bridge unit 28 is rotatable about a second axis 40 generally parallel to the first axis 38.

Figure 3:
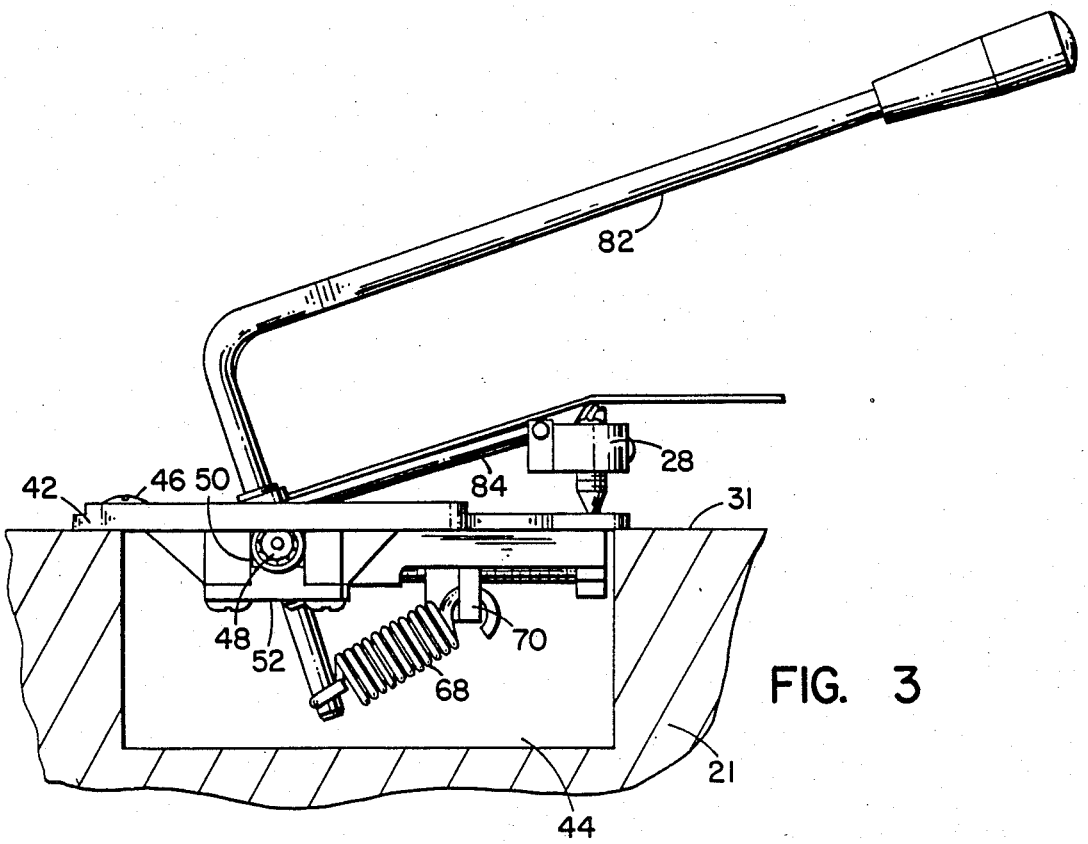
FIG. 3 is a side elevational view taken generally on the line 3—3 of FIG. 2.
Figure 4:
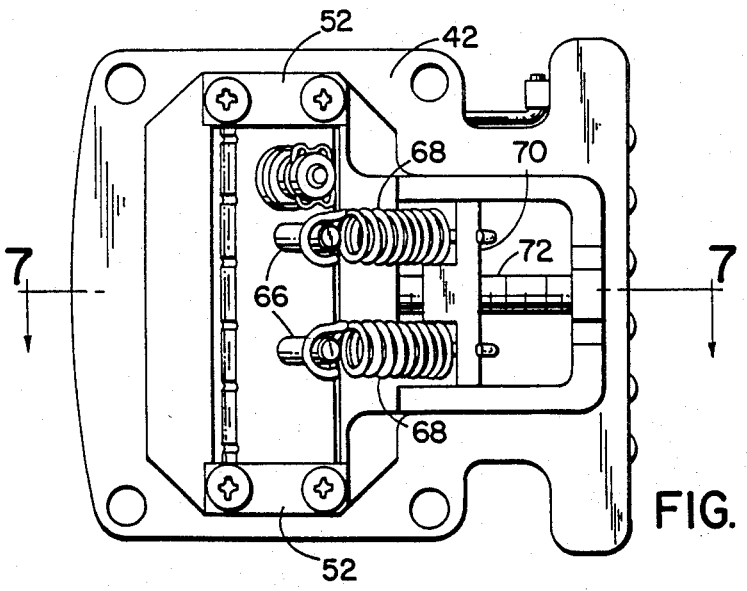
FIG. 4 is a bottom view of the tremolo tailpiece and bridge device of FIG. 1.

The rotatable support for the string anchor means and for the bridge unit may be provided in various different ways, but in the illustrated device 18 it is provided by a common base 42 partially located in a recess 44 in the instrument body 22, as best seen in FIG. 3, and held to the body by four mounting screws 46, 46. The anchor bar 22 has trunnions 48, 48 at its opposite ends and each of these is rotatably supported from the base 42 by a ball bearing unit 50 (FIG. 3) held in assembly with the base 42 by a retainer 52. The bridge unit 28 is in turn rotatably supported from the base 42 by two pivot screws 54, 54 threadably received by the opposite ends of the bridge body 30 and extending downwardly therefrom with each screw having a pointed lower end 56 received in a corresponding depression 58 in the base 42. Therefore, the bridge unit 28 rests on the pointed two lower ends of the two pivot screws 54, 54 and is rotatable on these points about the axis 40. The bridge unit 28 is further loosely connected with the base 42 and is held in assembly with it solely by the string forces which push downwardly on the bridge unit to hold the screw points 56, 56 in the depressions 58, 58. Of course, the screws 54, 54 may be rotated relative to the bridge to lower one or both ends of the bridge body to adjust the spacing between the strings and the fingerboard 25.

Figure 6:
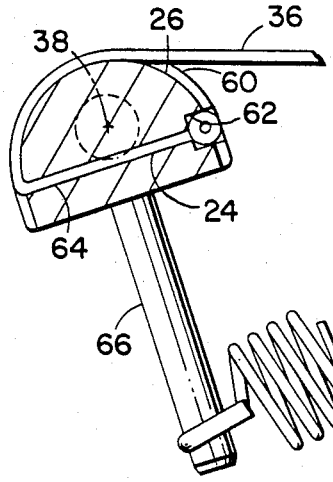
FIG. 6 is a transverse sectional view taken generally on the line 6—6 of FIG. 1 and showing a string attached to the illustrated anchor bar.

As mentioned previously, each of the string anchor means provided by the anchor bar 22 consists of an opening 24 extending through the anchor bar and a groove 26. The construction of these features is shown in more detail in FIG. 6 which represents a section through the anchor bar. As shown in FIG. 6, the anchor bar 22 has a curved upper surface 60 which is concentric with the axis 38 and each groove 26 is a circumferentially extending one formed in this surface. Further, the opening 24 extends from the front to the rear of the anchor bar, having a wide portion 62 at its forward end for receiving the bead of the associated string 36 and a smaller diametered portion 64 extending rearwardly from the wide portion 62 of lesser diameter than the string bead and at its rear mouth registering with the associated groove 26 so that the string 36 may be attached to the anchor bar in the manner shown in FIG. 6.

Figure 2:
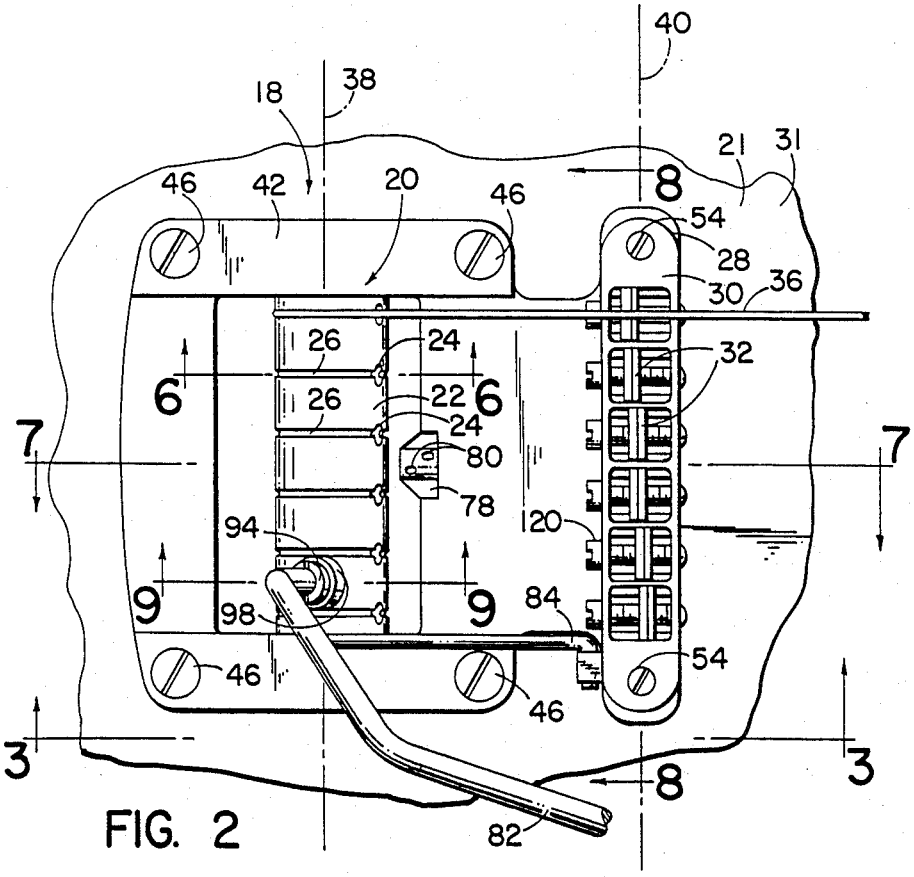
FIG. 2 is an enlarged plan view of the tremolo and bridge device of FIG. 1.
Figure 7:
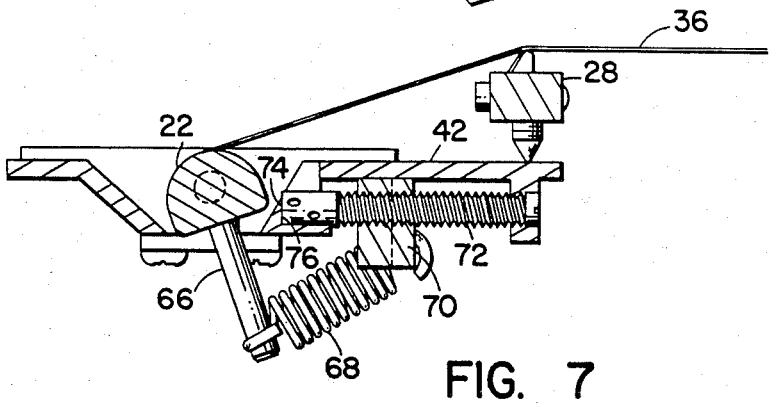
FIG. 7 is a sectional view taken on the line 7—7 of FIG. 2.

The forces of the strings acting on the anchor bar 22 tend to rotate it in the clockwise direction as viewed in FIGS. 3, 6 and 7. In opposition to these string forces the anchor bar 22 has a spring force applied to it which normally balances the string forces and holds the anchor bar 22 in a neutral position. The spring biasing mechanism consists of two pins 66 fixed to the underside of and extending downwardly from the anchor bar 22. The lower end of each pin 66 in turn has attached to it one end of a tension spring 68, the other end of which is attached to a block 70 supported for back and forth sliding motion relative to the undersurface of the base 42. The block 70 is positioned relative to the base by a screw 72 extending threadably through the block and rotatably supported by the base 42. As seen in FIG. 7 the lower end 74 of the screw is held, by the pressure of the springs 68, 68, against an abutment surface 76 provided by the base 42. The lower end portion of the screw 72 is further made accessible from the upper surface of the base, as seen in FIG. 2, by providing an aperture 78 in the base, and the portion of the screw which is accessible through the aperture 78 is provided with a number of transverse openings 80, 80 through which a pin or similar tool may be inserted for use in rotating the screw 72 to adjust the position of the block 70 to in turn adjust the biasing force exerted by the springs 68, 68 on the anchor bar 22.

In accordance with the invention the plurality of string anchor means, provided by the anchor bar 22, and the bridge unit 28 are rotated in synchronism back and forth about their respective axes 38 and 40 by an actuating means under the control of the player so that as the lower ends of the strings are moved by operation of the anchor bar the bridge unit moves with the anchor bar so as to create no tendency for the strings to move relative to the bridge. In the device 18 such synchronous motion is obtained by a tremolo arm 82 connected to the anchor bar 22 and by a link 84 drivingly connecting the bridge unit 28 to the anchor bar 22.

Figure 5:
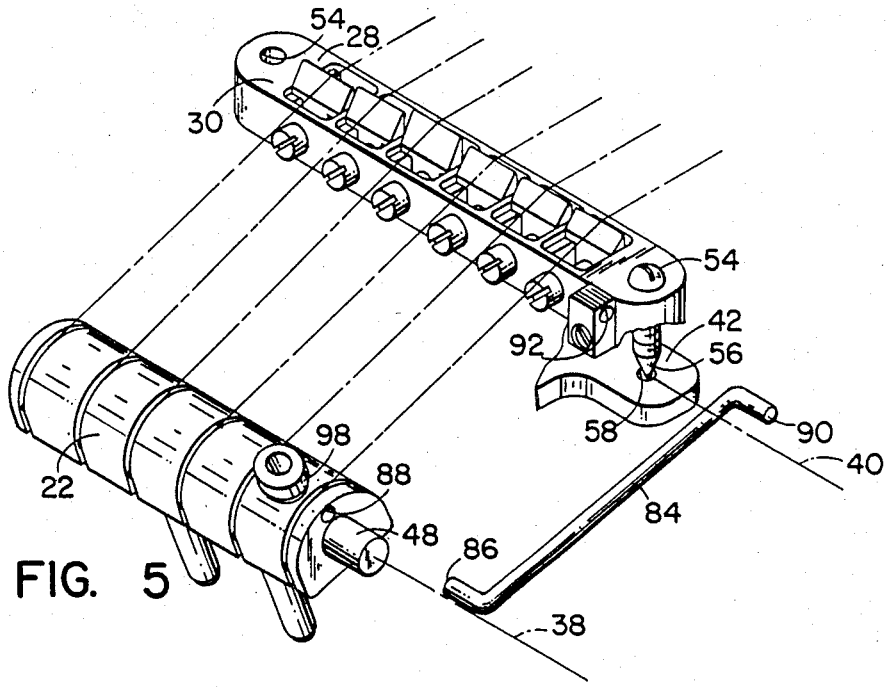
FIG. 5 is a perspective view showing the relationship between the string anchor bar and bridge unit of the FIG. 1 device.

Referring to FIG. 5 the link 84 has a lower end 86 which fits into an opening 88 in the associated end of the anchor bar 22 to provide a pivotal connection between the link 84 and the anchor bar and likewise the link 84 has an upper end 90 which loosely fits into an opening 92 on a lug formed on the bridge body 30 to provide a pivotal connection between the link and the bridge unit. Accordingly, back and forth motion of the anchor bar 22 about the axis 38 is communicated to the bridge unit 28 to cause simultaneous back and forth motion of the unit 28 about the axis 40.

Figure 9:
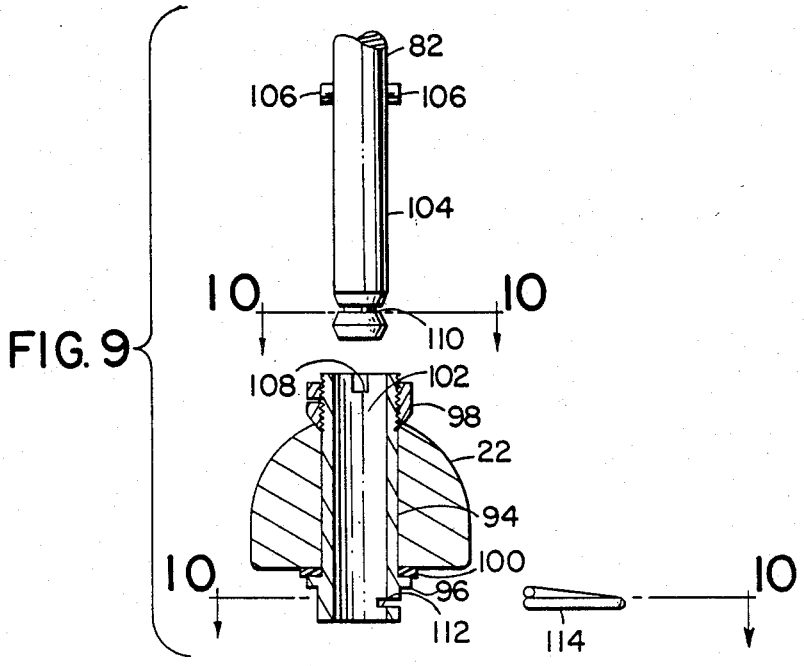
FIG. 9 is a partially exploded view taken generally on the line 9—9 of FIG. 2 and showing the construction of the connection between the tremolo arm and the anchor bar.
Figure 10:
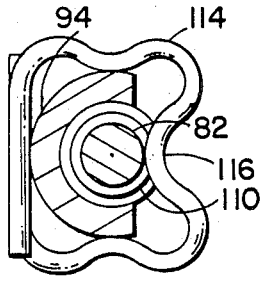
FIG. 10 is a view taken on the line 10—10 of FIG. 9.

FIGS. 9 and 10 show the connection between the tremolo arm 82 and the anchor bar 22. Referring to these figures, the anchor bar 22 has a connector 94, of circular cross section, passing through it. At the underside of the anchor bar 22 is a flange 96 on the connector which opposes the anchor bar and at its upper end the connector is threaded to receive a lock nut 98 which also opposes the anchor bar. Between the flange 96 and the anchor bar is a washer 100 of nylon or similar material. Therefore, by adjusting the nut 98 on the connector 94 the frictional force between the connector and the anchor bar may be adjusted to adjust the force required to rotate the connector 94 relative to the anchor bar about the longitudinal axis of the connector. Both the flange 96 and the nut 98 are each provided with at least two flats for the application of wrenches to accomplish this adjustment. The connector 94 also has a central bore 102 for receiving the associated end portion 104 of the tremolo arm 82. This end portion 104 has two radial pins 106, 106 which are received in corresponding slots in the connector 94 when the tremolo arm is in place in the connector (only one of such slots being shown at 108 in FIG. 9) to prevent rotation of the arm 82 relative to the connector 94 about the axis of the connector. Near the free end of the arm portion 104 is a groove 110 which aligns with a slot 112 in the connector 94 when the tremolo arm is in place in the connector. Normally attached to the connector 94 is a detent spring 114, such as shown in FIG. 10, having a nose portion 116 which extends into the connector slot 112 and is receivable in the groove 110 of the tremolo arm to releasably hold the tremolo arm in place in the connector 94. Therefore, it will be understood that the tremolo arm may be easily attached to or removed from the connector 94, and thus to and from the anchor bar 22, by merely pushing it into or pulling it from the connector 94.

Figure 8:
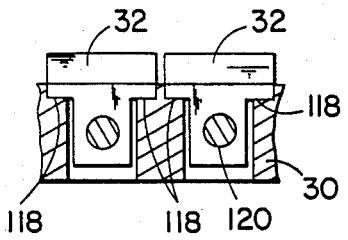
FIG. 8 is an enlarged fragmentary sectional view taken on the line 8—8 of FIG. 2.

The particular construction of the bridge unit 28 may vary widely, but in the illustrated device 18 each of the saddle members 32, 32 is adjustable forwardly and rearwardly relative to the bridge body 30 to adjust the intonation of the strings. As shown in FIG. 8 each saddle member 32 is of a T-shape having a head which at its lower end rests and slides on two lands 118, 118 of the bridge body 30, and each saddle member 32 threadably receives an associated screw 120 which may be rotated to adjust the position of the saddle member relative to the bridge body.

As mentioned, the tremolo tailpiece and bridge device of this invention may be designed for different types of mountings and different ones of its functions may be implemented in various different ways without departing from the broader aspects of the invention. By way of further example, FIGS. 11 to 15 show a tailpiece and bridge device 200 comprising another embodiment of this invention having a different type of mounting and other features somewhat different from the device 18. Referring to these figures the device 200 has a base 202 adapted to be mounted flush on the surface 204 of a guitar body 206 as by two mounting screws 208, 208 threaded into associated fittings (such as the one indicated at 210) fixed to the guitar body 206.

Figure 13:
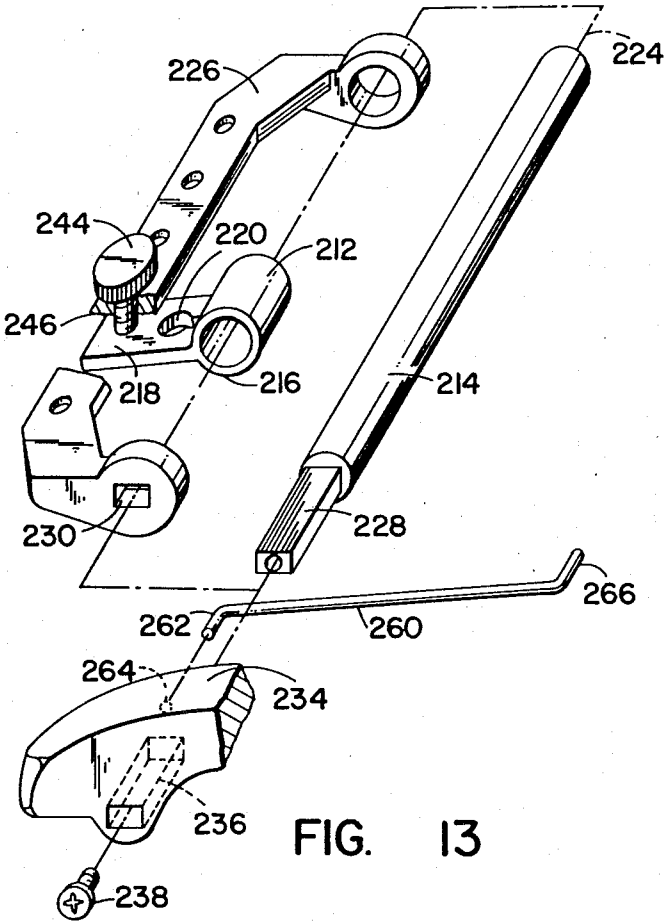
FIG. 13 is a perspective exploded view showing some of the parts of the FIG. 11 device.

The string anchor means of the device 200 comprises six string engaging members 212, 212 supported by a common shaft 214. As shown in FIG. 13 (which shows only one of the string engaging members) each string engaging member 212 includes a generally cylindrical portion 216 adapted to surround and to be rotatably received on the shaft 214 and a rearwardly extending tail portion 218 having a slot 220 for receiving the end of the associated string. The common shaft 214 is supported for rotational movement relative to the base 202 by two upstanding ears 222, 222 of the base and, if desired, ball or other anti-friction bearing units (not shown) may be used between the ears 222, 222 and the shaft 214. The axis of the shaft 214 forms the first axis 224 about which the plurality of string engaging members 212 are rotatable, and they are rotated in unison about this axis by a transversely extending operating member 226 which passes above the lower ends of the tail portions 218, 218 and at its opposite ends is received by the shaft 214. At the near end of the shaft as seen in FIG. 13 the shaft has a noncylindrical portion 228 which receives a conforming opening 230 in the associated end of the transverse member 226 so that the transverse member 226 is constrained to rotate with the shaft 214 about the axis 224.

The shaft 214 and the attached operating member 226 are rocked back and forth about the axis 224 by an associated tremolo arm 232 having a mounting part 234 also nonrotatably attached to the shaft portion 228 by means of a corresponding noncircular recess 236 in the part 234 which receives the shaft portion 228 and a screw 238 which holds the part 234 in assembly with the shaft 214. The remainder of the tremolo arm 232 is connected to the part 234 through a pivot joint 240 which permits swinging movement of the remainder of the tremolo arm 232 relative to the part 234 about an axis 242, thereby allowing the tremolo arm to be swung to an out of the way position when not required.

Between the operating member 226 and the tail portions 218, 218 of the string engaging members are a corresponding plurality of fine tuning devices allowing each string engaging member to be adjusted to achieve a fine tuning of the associated string. As seen best in FIG. 13 and FIG. 14 each of these fine tuning devices consists of a screw threaded into the operating member 226 and having a head 244 adjacent the upper side of the operating arm operable by the player to thread the screw into and out of the operating member and a lower end 246 which engages the tail portion 218 of the associated string engaging member 212 to shift the neutral position of the string engaging member relative to the shaft 214.

Figure 12:
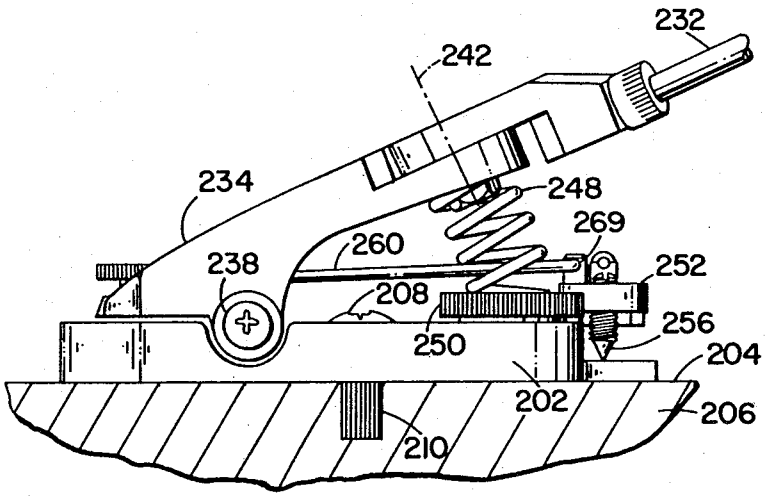
FIG. 12 is a side view of the tremolo tailpiece and bridge device of FIG. 11.
Figure 11:
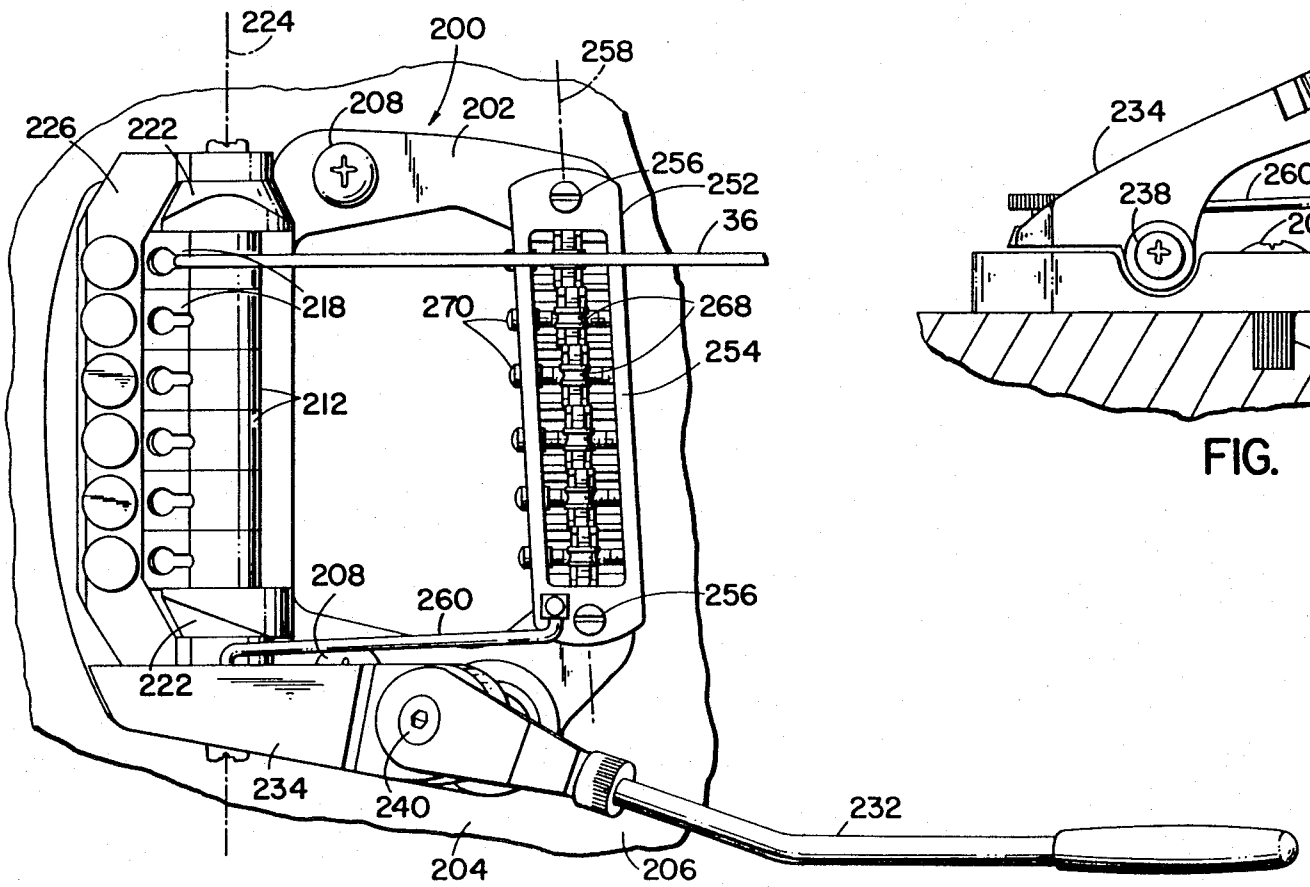
FIG. 11 is a top view of a tremolo tailpiece and bridge device comprising another embodiment of this invention.
Figure 14:
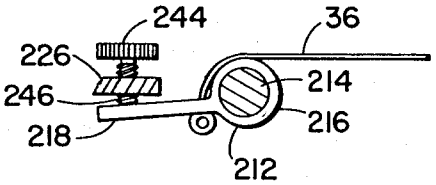
FIG. 14 is a sectional view taken on the line 14—14 of FIG. 11.
Figure 15:
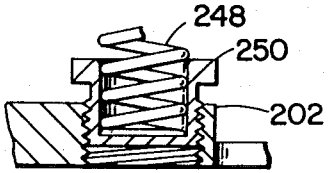
FIG. 15 is an enlarged fragmentary sectional view taken generally on the line 15—15 of FIG. 11.

It will be understood that when the strings are attached to the tail portions 218, 218 of the string engaging members they tend to pull upwardly on the tail portions bringing such tail portions to bear against the lower ends of the fine tuning screws. These string forces tending to rotate the string engaging members and the operating member 226 are in turn resisted by a compression spring 248 extending between the tremolo arm member 234 and the base 202 as seen in FIG. 12. Further, the lower end of the spring, as seen in FIG. 15, is received in a cup 250 which is threaded into the base 202 so that its heighth relative to the base may be adjusted to adjust the bias force exerted by the spring on the tremolo bar, thereby adjusting the neutral position of the tremolo bar and the plurality of string engaging members.

The bridge unit of the device 200 is indicated at 252 and comprises a body 254 supported from the base 202 by two pivot screws 256, 256 in the same manner as is the bridge unit 28 from the base 42 of the previously described device 18. That is, the two pivot screws 256, 256 support the bridge unit 252 for rotation relative to the base 202 about a second axis 258 parallel to the first axis 224.

To achieve a synchronization of the motion of the bridge unit 252 with that of the plurality of string engaging members, the bridge unit 252 is driven by a connecting link 260 having a forward end 262, seen best in FIG. 13, received in an opening 264 of the tremolo arm part 234 and an opposite end portion 266 received in an opening 269 in a lug on the bridge body. Therefore, as the tremolo arm is rocked back and forth by the player it not only rocks back and forth the operating member 226 and the associated string engaging members forming the tailpiece but also, through the connecting link 260, rocks back and forth the bridge unit 252 about the axis 258.

The actual construction of the bridge unit 252 may vary, but in the illustrated case of FIGS. 11 to 15 the actual string engaging members of the bridge unit are shown to be rollers 268, 268 which may be adjusted back and forth in the string direction to adjust the instrument's intonation by associated adjusting screws 270, 270.

I claim:

1. A tremolo tailpiece and bridge device for use with a guitar or similar stringed instrument, said device comprising:

a plurality of string anchor means, one for each of the strings of the instrument, means supporting said plurality of string anchor means adjacent the top surface of an instrument body at a location near the bottom end of the instrument and for rotational movement relative to said body about a common first axis extending generally transversely to the strings of the instrument and parallel to the top surface of the instrument's body, a bridge unit having means for engaging all of the strings of the instrument, means supporting said bridge unit adjacent said top surface of the instrument body some distance away from said plurality of string anchor means in the direction toward the neck of the instrument and for rotational movement relative to said body about a second axis extending generally parallel to said first axis, and means manually operable by the player of the instrument for synchronously rotating said plurality of string anchor means back and forth in unison about said first axis and said bridge unit back and forth about said second axis, said rotating means including linkage means other than said strings for coupling said string anchor means to said bridge unit.

2. A tremolo tailpiece and bridge device as defined in claim 1 further characterized by said means supporting said plurality of string anchor means and said means supporting said bridge unit comprising a common base adapted for attachment to the instrument.

3. A tremolo tailpiece and bridge device as defined in claim 2 further characterized by said means supporting said bridge unit for rotational movement about said second axis including two pivot screws threadably connected to opposite transverse ends of said bridge unit and having lower ends loosely received in depressions in said base and wherein said bridge unit is held in assembly with said base by the string forces bearing down on said bridge unit.

4. A tremolo tailpiece and bridge device as defined in claim 1 further characterized by said means manually operable by the player comprising a tremolo arm connected with said plurality of string anchor means and operable by the player for rotating said plurality of string anchor means back and forth in unison about said first axis.

5. A tremolo tailpiece and bridge device as defined in claim 1 further characterized by said plurality of string anchor means being provided by a one-piece string anchor bar to which all of the strings of the instrument are attachable.

6. A tremolo tailpiece and bridge device as defined in claim 5 further characterized by said means supporting said plurality of string anchor means and said means supporting said bridge unit being a common base adapted for attachment to the instrument, and said anchor bar being rotatably journaled to said base at the opposite ends of said anchor bar.

7. A tremolo tailpiece and bridge device as defined in claim 5 further characterized by said anchor bar having a curved upper surface generally arcuate about said first axis, and each of said plurality of string anchor means including an opening passing through said anchor bar below said arcuate surface for receiving the associated string of the instrument.

8. A tremolo tailpiece and bridge device as defined in claim 7 further characterized by each of said string anchor means including a groove in said arcuate upper surface of said anchor bar for receiving the associated string.

9. A tremolo tailpiece and bridge device as defined in claim 5 further characterized by a spring biasing means for urging said anchor bar in a direction about said first axis opposite to the direction in which said anchor bar is urged by the strings of the instrument which are attached to it.

10. A tremolo tailpiece and bridge device as defined in claim 9 further characterized by said spring biasing means including a means for adjusting the force exerted by said biasing means on said anchor bar.

11. A tremolo tailpiece and bridge device as defined in claim 10 further characterized by said means supporting said plurality of string anchor means and said means supporting said bridge unit comprising a common base rotatably supporting both said anchor bar and said bridge unit, said spring biasing means including a pin fixed to said string anchor bar between its ends and extending downwardly therefrom generally perpendicular to said first axis, and a spring connected between the lower end of said pin and said base.

12. A tremolo tailpiece and bridge device as defined in claim 11 further characterized by a slide block supported for sliding movement relative to the undersurface of said base in a direction generally parallel to the string direction, an adjustment screw threadably connected with said slide block and carried by said base for adjusting the position of said slide block relative to said base, and means connecting one end of said spring to said slide block and its other end to said pin so that the biasing force exerted by said spring on said anchor bar is varied with variations in the position of said slide block relative to said base.

13. A tremolo tailpiece and bridge device as defined in claim 12 further characterized by an aperture in said base making a portion of said adjustment screw accessible from the upper surface of said base, and means on the portion of said screw accessible through said aperture for engagement with a tool for rotating said screw.

14. A tremolo tailpiece and bridge device as defined in claim 1 further characterized by said bridge unit being a body carrying individual string engageable members, one for each string.

15. A tremolo tailpiece and bridge device as defined in claim 14 further characterized by said individual string engaging members being adjustable relative to said bridge body in the direction of the string which it engages.

16. A tremolo tailpiece and bridge device as defined in claim 14 further characterized each of said individual string engaging members being a roller supported for rotation relative to said bridge body about an axis perpendicular to its associated string.

17. A tremolo tailpiece and bridge device as defined in claim 16 further characterized by each of said rollers being adjustable relative to said bridge body in the direction parallel to its associated string.

18. A tremolo tailpiece and bridge device as defined in claim 1 further characterized by said plurality of string anchor means being a plurality of individual string engaging members one for each string, and a common shaft extending generally transversely of the strings of said instrument along said first axis, said individual string engaging members being located side-by-side on and rotatably supported by said common shaft, each of said individual string engaging members including a generally cylindrical portion surrounding said common shaft and a tail portion extending rearwardly from said common shaft, each of said tail portions having a slot therein for use in anchoring a string end to it with such string in use passing forwardly from said slot and over the cylindrical portion of the same string engaging member.

19. A tremolo tailpiece and bridge device as defined in claim 18 further characterized by a single base adapted for attachment to the instrument and supporting both said common shaft and said bridge unit.

20. A tremolo tailpiece and bridge device as defined in claim 18 further characterized by said means for rotating said plurality of string anchor means in unison back and forth about said first axis including an operating member extending transversely of the string direction adjacent said tail portions of said string engaging members and supported for rotation about said first axis, and coengaging means between said tail portions and said operating member for moving said tail portions of said string engaging members in unison about said common shaft in response to back and forth rotation of said operating member.

21. A tremolo tailpiece and bridge device as defined in claim 20 further characterized by said coengaging means including a fine tuning means between each of said tail portions and said operating member for adjusting the position of each tail portion relative to said operating member.

22. A tremolo tailpiece and bridge device as defined in claim 21 further characterized by said transverse operating member being located above all of said tail portions, and each of said fine tuning devices comprising a screw threadably received by said operating member with each screw having a head on the upper side of said operating member rotatable by the player and a lower end portion extending downwardly from said operating member into engagement with the associated tail portion.

23. A tremolo tailpiece and bridge device as defined in claim 20 further characterized by said operating member being connected with said common shaft for rotation therewith, and a tremolo arm operable by the player connected with said common shaft for rotating said common shaft.

24. A tremolo tailpiece and bridge device as defined in claim 23 further characterized by a spring means for biasing said operating member in a direction about said first axis opposite to the direction in which said string engaging members are urged about said first axis by the strings attached to said string engaging members.

25. A tremolo tailpiece and bridge device as defined in claim 24 further characterized by said spring biasing means including means for adjusting the spring force exerted by said spring biasing means on said operating member.

26. A tremolo tailpiece and bridge device as defined in claim 25 further characterized by a single base adapted for attachment to the instrument and supporting both said common shaft and said bridge unit, and said spring biasing means being a compression spring extending between said tremolo arm and said base, the end of said spring adjacent said base being received in a cup threadably received by said base for adjusting said spring tension force.

27. A tremolo tailpiece and bridge device for use with a guitar or similar stringed instrument, said device comprising:

a plurality of string anchor means, one for each of the strings of the instrument, provided by a one-piece string anchor bar to which all of the strings of the instrument are attachable, means supporting said plurality of string anchor means adjacent the top surface of an instrument body at a location near the bottom end of the instrument and for rotational movement relative to said body about a common first axis extending generally transversely to the strings of the instrument and parallel to the top surface of the instrument's body, a bridge unit having means for engaging all of the strings of the instrument, means supporting said bridge unit adjacent said top surface of the instrument body some distance away from said plurality of string anchor means in the direction toward the neck of the instrument and for rotational movement relative to said body about a second axis extending generally parallel to said first axis, said means supporting said plurality of string anchor means and said means supporting said bridge unit being a common base adapted for attachment to the instrument, and said anchor bar being rotatably journaled to said base at the opposite ends of said anchor bar, and means manually operable by the player of the instrument for synchronously rotating said plurality of string anchor means back and forth in unison about said first axis and said bridge unit back and forth about said second axis, said means manually operable by the player including a tremolo arm connected to said anchor bar for directly rotating said anchor bar back and forth about said first axis, and a connecting link having one end pivotally connected to said anchor bar and an opposite end pivotally connected to said bridge unit for driving said bridge unit back and forth about said second axis in response to the back and forth movement of said anchor bar about said first axis.

28. A tremolo tailpiece and bridge device as defined in claim 27 further characterized by a detent means for releasably connecting said tremolo arm to said anchor bar.

29. A tremolo tailpiece and bridge device as defined in claim 28 further characterized by said detent means comprising a connector member passing through said anchor bar along an axis generally perpendicular to said first axis, said connector member having one end with a flange opposing said anchor bar on one side of said anchor bar and an opposite threaded end which receives a nut for opposing said anchor bar on its opposite side and which nut is threadably adjustable relative to said connecting member to vary the force required to rotate said connecting member relative to said anchor bar about the axis of said connecting member, said connector member having a bore for receiving an associated end of said tremolo arm, means on said connector member and said tremolo arm for preventing rotation of said tremolo arm relative to said connector member about the axis of said connecting member when said associated end of said tremolo arm is inserted into said connector member bore, said tremolo arm having a circumferential groove, and a detent spring carried by said connector member and having a detent portion receivable by said tremolo arm groove to releasably hold said tremolo arm in said bore and to yieldingly permit said associated end of said tremolo arm to be inserted into and removed from said connector member.

30. A tremolo tailpiece and bridge device for use with a guitar or similar stringed instrument, said device comprising:

a plurality of string anchor means, one for each of the strings of the instrument, provided by a one-piece string anchor bar to which all of the strings of the instrument are attachable, means supporting said plurality of string anchor means adjacent the top surface of an instrument body at a location near the bottom end of the instrument and for rotational movement relative to said body about a common first axis extending generally transversely to the strings of the instrument and parallel to the top surface of the instrument's body, a bridge unit having means for engaging all of the strings of the instrument, means supporting said bridge unit adjacent said top surface of the instrument body some distance away from said plurality of string anchor means in the direction toward the neck of the instrument and for rotational movement relative to said body about a second axis extending generally parallel to said first axis, said means supporting said plurality of string anchor means and said means supporting said bridge unit being a common base adapted for attachment to the instrument, and said anchor bar being rotatably journaled to said base at the opposite ends of said anchor bar, and means manually operable by the player of the instrument for synchronously rotating said plurality of string anchor means back and forth in unison about said first axis and said bridge unit back and forth about said second axis, said means for synchronously rotating said plurality of string anchor means back and forth in unison about the first axis and the bridge unit back and forth about said second axis including a connecting link having one end pivotally connected to said anchor bar and an opposite end pivotally connected to said bridge unit.

31. A tremolo tailpiece and bridge device for use with a guitar or similar stringed instrument, said device comprising:

a common shaft extending generally transversely of the strings of said instrument along a first axis, means supporting said common shaft parallel to and adjacent the top surface of said instrument's body at a location near the bottom end of the instrument, a plurality of individual string anchor means, one for each of the strings of the instrument, each of said string anchor means including a generally cylindrical portion surrounding and rotatably supported by said common shaft and a tail portion extending rearwardly from said common shaft, said tail portion having a slot therein for use in anchoring a string end to it with said string passing forwardly from said slot and over said cylindrical portion, a bridge unit having means for engaging all of the strings of the instrument, means supporting said bridge unit adjacent said top surface of the instrument body some distance away from said common shaft in the direction toward the neck of the instrument and for rotational movement relative to said body about a second axis extending generally parallel to said first axis, and actuating means manually operable by the player of the instrument for synchronously rotating said plurality of string anchor means back and forth in unison about said first axis and said bridge unit back and forth about said second axis, said actuating means including an operating member extending transversely of said strings and located above all of said tail portions, said operating member being supported for rotation about said first axis, coengaging means between said tail portions and said operating member for moving said tail portions in unison about said common shaft in response to back and forth rotation of said operating member, said coengaging means including a fine tuning device between each of said tail portions and said operating member for adjusting the position of each tail portion relative to said operating member, each of said fine tuning devices comprising a screw threadably received in said operating member with each screw having a head on the upper side of said operating member rotatable by the player and a lower end portion extending downwardly from said operating member into engagement with the associated tail portion, a tremolo arm operatively connected with said operating member for effecting back and forth rotation of said operating member about said first axis, and a connecting link having one end pivotally connected with said tremolo arm and another end pivotally connected with said bridge unit so that movement of said tremolo arm causes synchronous movement of both said operating member and said bridge unit.

32. A tremolo tailpiece and bridge device for use with a guitar or similar stringed instrument, said device comprising:

a plurality of string anchor means, one for each of the strings of the instrument, means supporting said plurality of string anchor means adjacent the top surface of an instrument body at a location near the bottom end of the instrument and for rotational movement relative to said body about a common first axis extending generally transversely to the strings of the instrument and parallel to the top surface of the instrument's body, a bridge unit having means for engaging all of the strings of the instrument, said bridge unit including a bridge body and said string engaging means being a plurality of rollers carried by said bridge body each engaging a respective one of said strings, means supporting said bridge unit adjacent said top surface of the instrument body some distance away from said plurality of string anchor means in the direction toward the neck of the instrument and for rotational movement relative to said instrument body about a second axis extending generally parallel to said first axis, and actuating means manually operable by the player of the instrument for synchronously rotating said plurality of string anchor means back and forth in unison about said first axis and said bridge unit back and forth about said second axis, said actuating means including linkage means other than said strings for coupling said string anchor means to said bridge unit.

33. A tremolo tailpiece and bridge device for use with a guitar or similar stringed instrument, said device comprising:

a plurality of string anchor means, one for each of the strings of the instrument, means supporting said plurality of string anchor means adjacent the top surface of an instrument body at a location near the bottom end of the instrument and for rotational movement relative to said body about a common first axis extending generally transversely to the strings of the instrument and parallel to the top surface of the instrument's body, a bridge unit having means for engaging all of the strings of the instrument, means supporting said bridge unit adjacent said top surface of the instrument body some distance away from said plurality of string anchor means in the direction toward the neck of the instrument and for rotational movement relative to said body about a second axis extending generally parallel to said first axis, and means manually operable by the player of the instrument for synchronously rotating said plurality of string anchor means back and forth in unison about said first axis and said bridge unit back and forth about said second axis, said means manually operable by the player comprising a tremolo arm connected with said plurality of string anchor means and operable by the player for rotating said plurality of string anchor means back and forth in unison about said first axis, and a means drivingly connected between said plurality of string anchor means and said bridge unit for rotating said bridge unit back and forth about said second axis in response to the back and forth rotational movement of said plurality of string anchor means about said first axis, said drivingly connected means being a connecting link having one end pivotally connected to said plurality of string anchor means and another end pivotally connected to said bridge unit.

* * * * *